United States Patent [19]

Kajita et al.

[11] Patent Number: 4,896,885

[45] Date of Patent: Jan. 30, 1990

[54] GOLF CLUB

[75] Inventors: Ryota Kajita, Chiba; Hidekimi Inoue, Saitama, both of Japan

[73] Assignee: Bridgestone Corporation, Tokyo, Japan

[21] Appl. No.: 203,225

[22] Filed: Jun. 6, 1988

[30] Foreign Application Priority Data

Jun. 5, 1987 [JP] Japan ..... 62-140943

[51] Int. Cl.[4] ..... A63B 53/04; A63B 53/02

[52] U.S. Cl. ..... 273/167 H; 273/80 C; 273/80.2; 273/171

[58] Field of Search ..... 273/167 G, 80 C, 81.3, 273/167 H, 167 R, 167 F, 167 K, 169, 170, 171, 172, 175, 80.2

[56] References Cited

U.S. PATENT DOCUMENTS

| | | | |
|---|---|---|---|
| 1,582,836 | 4/1926 | Link | 273/167 H |
| 3,081,087 | 3/1963 | Redd | 273/167 H |
| 3,166,320 | 1/1965 | Onions | 273/80 C |
| 3,980,301 | 9/1976 | Smith | 273/80 C |
| 4,139,196 | 2/1979 | Riley | 273/167 H |
| 4,438,931 | 3/1984 | Motomiya | 273/167 H |
| 4,697,813 | 10/1987 | Inoue | 273/167 H |

FOREIGN PATENT DOCUMENTS

| | | | |
|---|---|---|---|
| 899562 | 6/1962 | United Kingdom | 273/80 C |

*Primary Examiner*—George J. Marlo

*Attorney, Agent, or Firm*—Jordan and Hamburg

[57] ABSTRACT

Golf clubs and of the wood type have a relation between the axis of the shaft and the hitting spot on the head face thereof such that, under the assumption that the relation between the axis of the shaft and the head face both thereof in a plane squarely facing a golfer using the golf clubs is negative when the hitting spot is before the axis in the direction of ball's flight and positive when the hitting spot is after the axis in that direction, the distance y between the axis and hitting spot is greater than −3 mm and this is attributable to bending of the neck of the head, the shaft being straight.

5 Claims, 4 Drawing Sheets

GOLF CLUB

BACKGROUND OF THE INVENTION

1. Field of the Invention

The present invention relates to golf clubs called wood clubs or woods, and more particularly to golf clubs having an improved relation between the axis of the club shaft and the hitting spot on the club face.

2. Description of the Prior Art

In case of the wood clubs among the conventional golf clubs, an axis X passing through the center of the shaft 1 thereof and a line X' passing through the hitting spot H and parallel to the axis X lie in a plane squarely facing to the golfer as shown in FIG. 1. Assume here that the distance between X and X' in the above-mentioned plane is y. The hitting spot H on the club face lies before the axis X in the direction of ball's flight. Taking as positive the relation between the axis X and hitting spot H when the former is before the latter and the relation as negative when the former is after the latter, the distance y between X and X' is within a range of about −5 to −20 mm with the woods, and is within a range of about −1 to 5 mm with the irons.

Conventionally, the heads 2 of woods are made of a persimmon. For the persimmon-made heads, the value of y has to be set to less than −15 mm for reasons of their strength. The heads of woods have been traditionally made of a persimmon. The shape of the wood-club head made of persimmon has been taken even in case the club heaads are made of a metal or FRP (fiber reinforced plastic). As the result, the woods have the head shape rather different from the shape of the irons.

Currently, the heads 2 of woods are made of a metal, FRP or the like and have a considerably high strengh as compared with the persimmon head, but remain almost unchanged in shape. That is to say, any of the club heads 2 made of persimmon, metal and FRP, respectively, has a shape with the value of y being less than −5 mm, so that hitting of the ball B by an average golfer with a wood is likely to result in a slice. He swings trying to hit the ball B at a spot of the club head which lies on the shaft 1, namely, on or near the extension of the grip. Then the ball B is hit by the club head earlier than he thinks because the hitting spot H lies before the shaft 1. The ball is hit by the club head before he has completely directed the club face toward the target. That is, the ball is hit with the club face open. At this time, a slicing rotation is imparted to the ball as shown in FIG. 3 even if the head 2 is swung along the line of ball's flight Z. Also at the time of his swing, the wrist rotates (causing the rotation of the head around the shaft 1 and rolling of the head) and the velocity v of the hitting spot H resulting from the wrist rotation acts to impart a slicing rotation to the ball B as shown in FIG. 2. This velocity v of the hitting spot H is determined from the equation $v=r\,\omega$ (where r is a distance from the center of the rolling to the hitting spot H and $\omega$ is an angular velocity of rotation). If he tries to hit the ball B with the club face somewhat closed on purpose as shown in FIG. 4 in order to correct the slice, the ball thus hit will result in a hook. However, this hitting technique cannot easily be attained by average golfers. The professional and skillful golfers have a full understanding of the differences besween the woods and irons and use the clubs based on their skill and extensive experience. The majority of the average or beginner golfers use both the woods and irons in a same manner.

The ball hit by the average golfer with a wood is apt to result in a slice.

SUMMARY OF THE INVENTION

Therefore, the present invention has an object to provide golf clubs differing in the distance y from conventional golf clubs and with which the average golfers can hit the golf ball with little possiblity of slicing.

The object of the present invention is attained by providing golf clubs called woods of the distance y greater than −3 mm.

The conventional wood having a head made of persimmon, called "driver" has the distance y of about −20 mm. When a golfer swings to hit a golf ball with a driver at a point on the extension of the club grip by handling the club at a wrist rotation speed of 500 rpm and a club head speed of 40 m/sec, the ball will be hit with the clubface open about 1.5 degrees, resulting in a slice. However, with a wood having the distance y of more than −3 mm according to the present invention, the club head will hit the ball with the club face being slightly closed, thus resulting in a straight ball or somewhat hooked ball.

These and other objects and advantages of the present invention will be better understood from the ensuing description made by way of example of the embodiment of golf club according to the present invention with reference to the drawings.

DETAILED DESCRIPTION OF THE PREFERRED EMBODIMENT

Figure 11:
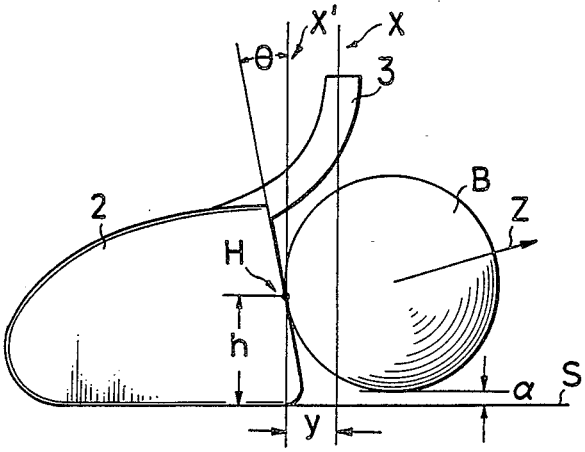
FIG. 11 is left side elevation showing a preferred embodiment of the present invention.

Referring now to FIG. 11, the distance between the axis X of a club shaft and a line X' passing through a hitting spot H on the club face and parallel to the axis X, namely, between the axis X and line X' in a plane squarely facing to the golfer, is selected to be negative. Say, the hitting spot H is placed after the axis X in the direction of ball's flight. The hitting spot H is a geometrical hitting point. Under the assumption that the height from the point of contact with the horizontal plane S of the sole of the head 2 is h, this height is defined by the following equation;

$$h=A(1-\sin\theta)+\alpha$$

where $\theta$: Angle of loft

A: Radius of the ball B $\alpha$: Height of the ball bottom from the ground

Figure 1:
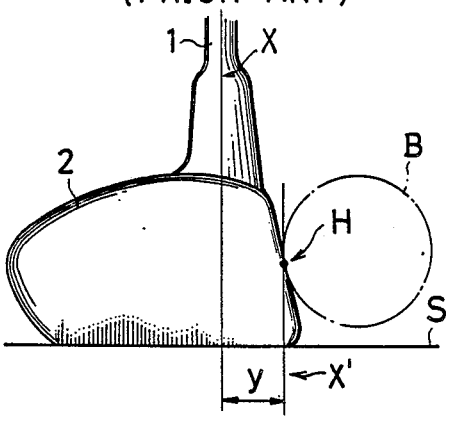
FIG. 1 (PRIOR ART)
FIG. 1 is a left side elevation of a conventional wood.
Figure 2:
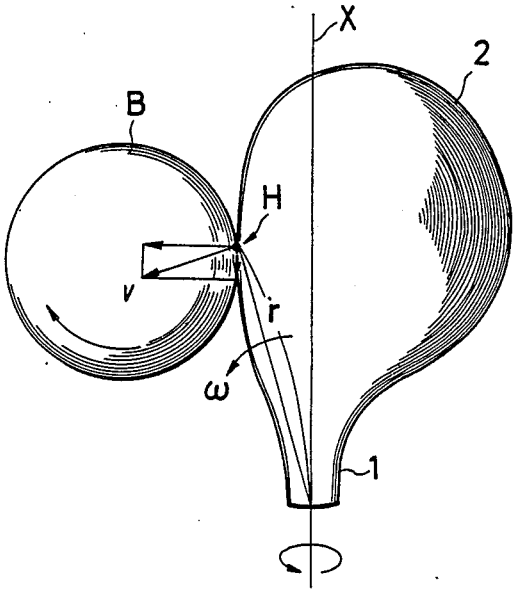
FIG. 2 (PRIOR ART)
FIG. 2 is a plan view for explaining the action upon the golf ball of the conventional wood.
Figure 3:
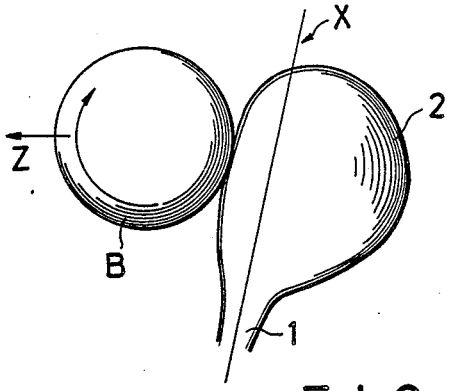
FIG. 3 (PRIOR ART)
FIG. 3 is a plan view showing the state in which the ball is acted upon by a slicing impact.
Figure 4:
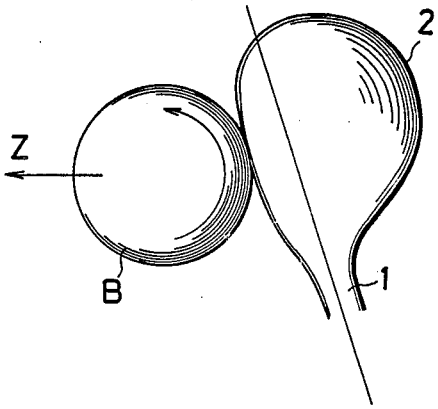
FIG. 4 (PRIOR ART)
FIG. 4 is a plan view showing the state in which the ball is acted upon by a hooking impact.
Figure 5:
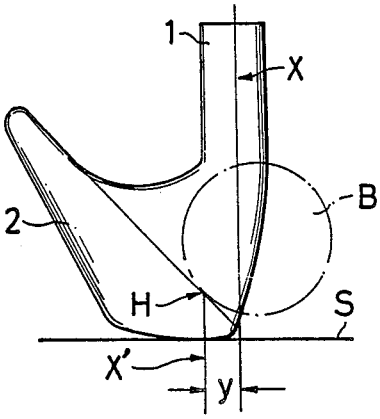
FIG. 5 (PRIOR ART)
FIG. 5 is a left side elevation of a conventional iron.
Figure 6A:
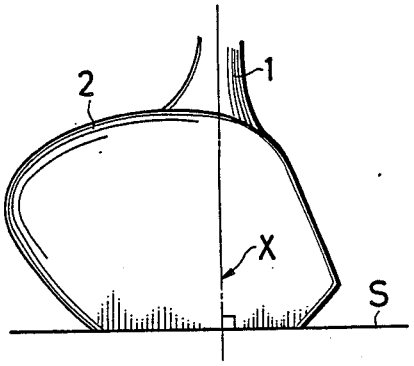
FIG. 6(a) (PRIOR ART)
FIGS. 6(*a*) and (*b*) through FIGS. 10(*a*) and (*b*) are left side elevations and front views, respectively, showing the state in which club heads of various forms are set for measurement of the value of y.
Figure 6B:
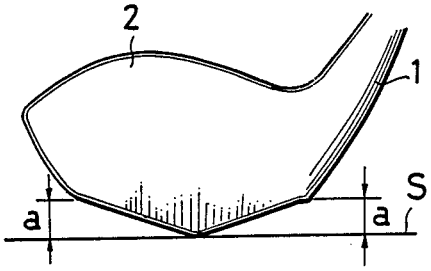
FIG. 6(b) (PRIOR ART)
Figure 7A:
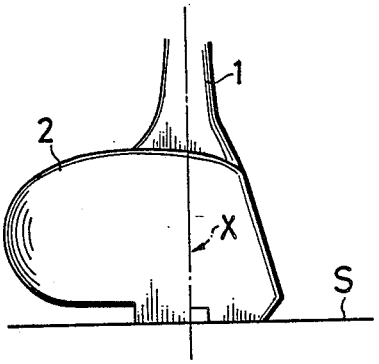
FIG. 7(a) (PRIOR ART)
Figure 7B:
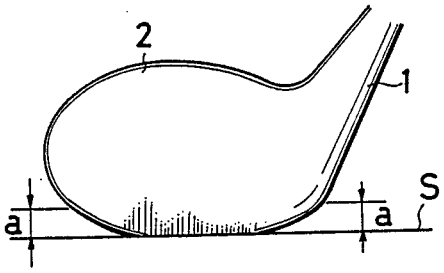
FIG. 7(b) (PRIOR ART)
Figure 8A:
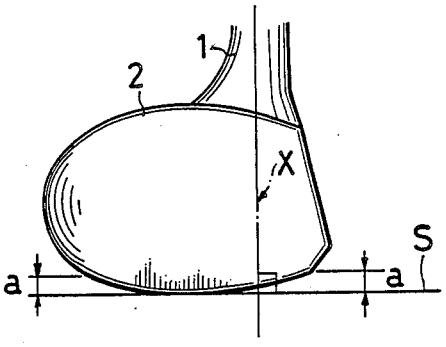
FIG. 8(a) (PRIOR ART)
Figure 8B:
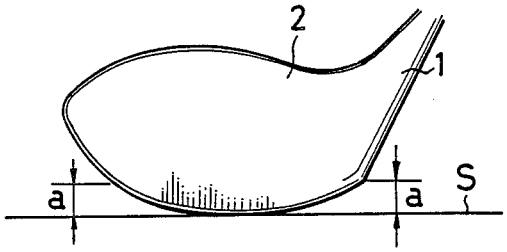
FIG. 8(b) (PRIOR ART)
Figure 9A:
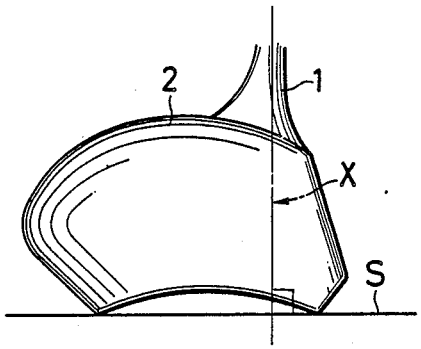
FIG. 9(a) (PRIOR ART)
Figure 9B:
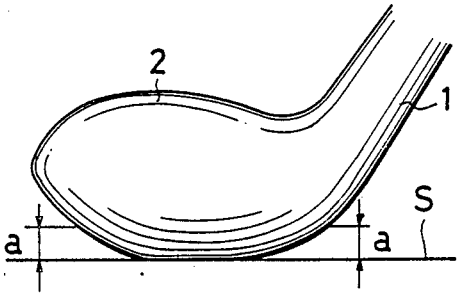
FIG. 9(b) (PRIOR ART)
Figure 10A:
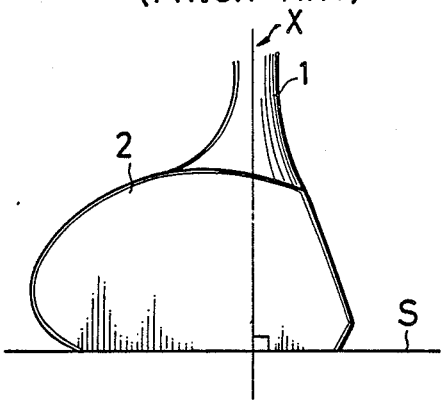
FIG. 10(a) (PRIOR ART)
Figure 10B:
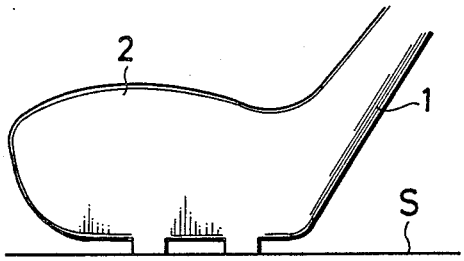
FIG. 10(b) (PRIOR ART)
Figure 12:
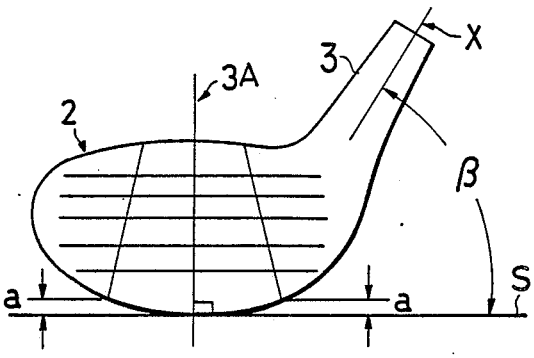
FIG. 12 is a front view of the golf club head in FIG. 11.
Figure 13:
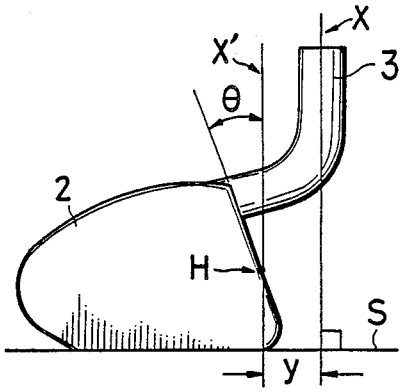
FIG. 13 is a left side elevation of the golf club head in FIG. 11.
Figure 14:
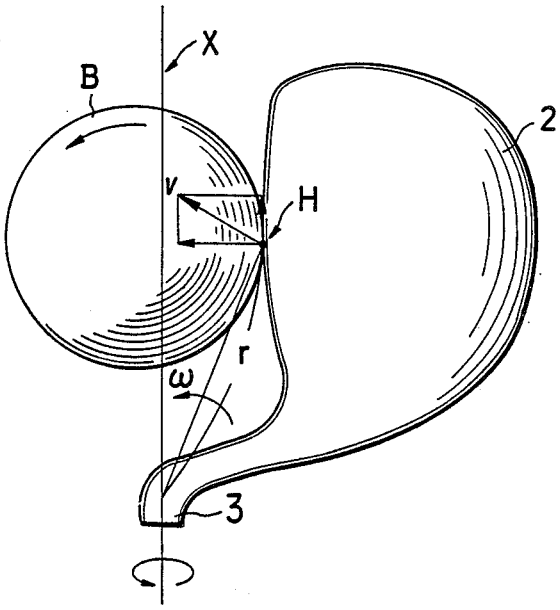
FIG. 14 is a plan view explaining the action of the club head upon the ball at the time of impact.

Here, the ball-bottom height $\alpha$ is selected to be 2.5 mm in consideration of the lawn height, and a ball of 21.4 mm in radius, namely, a large ball, is used. The arrow Z in FIG. 11 indicates the direction of flight of the ball B (line of flight). The distance y, hitting spot H, angle of loft $\theta$ and angle of lie $\beta$ shown in FIGS. 11 to 13 are defined as follows. First, in FIGS. 11 and 13 a plane is squarely viewed in which lies the axis X which is coaxial with the axis of the shaft and which is perpendicular to the horizontal plane S (ground surface). The axis X is also coaxial with the axis of the top of the neck 3 of the club head 2. Next, the sole of the club head 2 is placed on the horizontal plane S, and an imaginary line 3A is assumed which passes through the spot of contact with the plane S and perpendicular to the plane S (FIG. 12). The club head is finally set by moving the spot of contact between the sole contour and horizontal plane S so that the sole contour is nearly horizontally symmetrical in the maximum range with respect to the imaginary line 3A. In this state, the angle of lie $\beta$ (see FIG. 12) and angle of loft $\theta$ (see FIG. 13) are determined, the hitting spot H is determined based on the height h already defined, and the distance y shown in FIG. 13 is measured. In case of the heads 2 taking various forms, the golf clubs are set as shown in FIGS. 6(*a*) and (*b*) to FIGS. 10(*a*) and (*b*) in order to determine the hitting spot H. Thus, the selection of the distance y to be positive in the direction of the ball's flight can be attained by using as the material of the head 2 a metal or FRP superior in strength to persimmon.

When an average golfer swings trying to hit at a point in the extension of the club grip the ball B with the golf club thus constructed, the head 2 will catch the ball B somewhat later than his try and the velocity of the hitting spot H due to the rotation of his wrist will surely act in such as manner as to impart a hooking rotation to the ball B.

The results of various experiments with the golf club according to the present invention proved that the distance y of more than −3 mm prevented any slice from resulting when any average golfer used the golf club according to the present invention. The material of the head 2 should preferably be a metal or FRP. It should be noted that the tests made using the golf clubs in practice also proved that in case the distance y exceeds 20 mm, the ball hit by such golf clubs was likely to hook. However, the distance y may be longer or equal to 20 mm for some golfers. That is to say, any golfer whose swing always results in an extreme slice would be able to hit a hook or straight ball (leading to a long distance of the ball's flight) by using a golf club of which the distance y is more than 20 mm. Also, it was proved that with a golf club of the distance y being less than −3 mm, a slice easily resulted.

Figure 15:
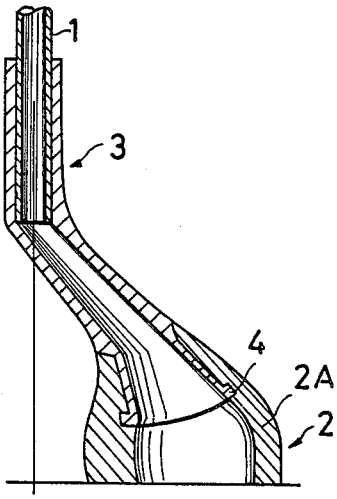
FIG. 15 is a sectional view showing the internal structure of the head of the golf club according to the present invention.

The head 2 of a golf club constructed as having been described in the foregoing comprises a neck 3 in which the shaft 1 is introduced and a head body 2A, the neck 3 and the head body 2A being integrally molded and constituted of respective different materials or being joined after being made of respective different materials, as shown in FIG. 15. The neck 3 should preferably be made of a material selected from among stainless steel, iron, titanium, aluminum, etc. that has a specific gravity of more than 2.5 and also a higher strength against rupture than head body 2A. Also, the lower end of the neck 3 is formed enlarged like a funnel and disposed so as to integrally fit the inner circumference of the head body 2A and its edge 4 is anchored by being embedded in the head body 2A as shown. The head body 2A should preferably be made of a carbon fiber reinforced plastic, any other plastic, aluminum or the like and its inside may be hollow or filled with a ligh-weight expanded material. Owing to this head structure, the neck 3 is not easily broken and it is possible to distribute the weight of the entire head 2 around the head body 2A, thereby improving the impact performance (capability of stabilizing the line of the ball's flight). Also, by preparing a variety of necks 3 different in shapes, it is possible to readily mold heads 2 having necks 3 of various shapes, respectively, if only the dies or even only the upper die for a head body 2A is available, which leads to reduction of the costs for manufacturing golf clubs.

What is claimed is:

1. A golf club of the wood type, comprising a club head and a shaft, the club head comprising a hollow neck and a body having a sole and having a golf ball striking face including a golf ball hitting spot H, the hollow neck fixedly receiving the shaft, the shaft being straight, and the neck having an end portion remote from the body of the head which end portion is straight and coaxial with the shaft for receiving the shaft and a hollow portion closer to the body of the head which is inclined to such extent that, unde the assumption that the relation between the axis X of the shaft and the hitting spot H both in vertical planes squarely facing a golfer using the golf club is negative when the hitting spot H is before the axis X in the direction of flight of the golf ball and positive when the hitting spot H is after the axis X in that direction, the horizontal distance y between the axis X and hitting spot H, which distance Y is perpendicular to said planes, is greater than −3 mm.

2. A golf club according to claim 1, in which y ranges from 0 to 20 mm.

3. A golf club according to claim 1, in which the loft of the striking face is less than 23 degrees.

4. A golf club according to claim 3 in which the loft of the striking face is less than 18 degrees.

5. A golf club according to claim 1, in which the hitting spot H is a point on the face of the head which contacts a ball when the club is set on the ground with the sole of the head squarely or symmetrically supporting the head and the face of the head contacting a ball supported by grass growing from the ground, the height h of the hitting spot H above the plane of the ground in contact with the sole being defined by the equation $$h=A(1-\sin\theta)+\alpha,$$

in which $\theta$=angle of loft of the club,

A=radius of the ball, $\alpha$=height above the ground the bottom of the ball is supported by the grass.

* * * * *